US011387585B2

(12) United States Patent
Morello et al.

(10) Patent No.: US 11,387,585 B2
(45) Date of Patent: Jul. 12, 2022

(54) ANTI-FRETTING/MULTIPLE CONTACT TERMINAL USING KNURL PATTERN

(71) Applicant: Aptiv Technologies Limited, St. Michael (BB)

(72) Inventors: John Morello, Warren, OH (US); James M. Rainey, Warren, OH (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/985,595

(22) Filed: Aug. 5, 2020

(65) Prior Publication Data

US 2022/0045452 A1 Feb. 10, 2022

(51) Int. Cl.
*H01R 13/187* (2006.01)
*H01R 13/11* (2006.01)

(52) U.S. Cl.
CPC ..... *H01R 13/187* (2013.01); *H01R 13/113* (2013.01)

(58) Field of Classification Search
CPC .. H01R 13/187; H01R 13/193; H01R 13/113; H01R 13/111; H01R 13/10; H01R 13/08; H01R 13/15; H01R 13/20; H01R 13/2492
USPC ..... 439/856
See application file for complete search history.

(56) References Cited

U.S. PATENT DOCUMENTS 3,228,207 A * 1/1966 Hartmann, Jr. ..... H01R 13/115 439/849
5,186,664 A * 2/1993 Abe ..... H01R 13/187 439/843
5,588,884 A * 12/1996 Rudoy ..... H01R 13/187 439/787
5,681,190 A * 10/1997 Childs ..... H01R 13/11 439/842
5,911,605 A * 6/1999 Wooldridge ..... H01R 13/28 439/790
6,007,345 A * 12/1999 Francis ..... F16F 9/463 439/34
6,139,376 A * 10/2000 Ooya ..... H01R 13/187 439/843
6,692,316 B2 * 2/2004 Hsieh ..... H01R 13/187 439/224
7,204,728 B2 * 4/2007 Noro ..... H01R 13/115 439/752.5

(Continued)

FOREIGN PATENT DOCUMENTS

EP 0657961 A2 6/1995
EP 2006958 A2 12/2008

(Continued)

OTHER PUBLICATIONS

Extended European Search Report for EP Application No. 21189004.1, dated Dec. 23, 2021, 8 pages.

*Primary Examiner* — Harshad C Patel
(74) *Attorney, Agent, or Firm* — Billion & Armitage

(57) ABSTRACT

A female electrical terminal includes a securing end and a mating end coupled along a longitudinal axis to the securing end. The mating end includes a housing provided with an opening configured to receive a male contact. A contact pad located within the housing is oriented to be brought into contact with the male contact received within the opening, wherein a surface of the contact pad includes a plurality of protrusions extending from the surface.

16 Claims, 5 Drawing Sheets

(56) References Cited

U.S. PATENT DOCUMENTS 7,241,189 B2 * 7/2007 Mohs ..... H01R 13/113 439/845
7,252,559 B1 * 8/2007 Morello ..... H01R 4/185 439/843
7,845,993 B2 * 12/2010 Falchetti ..... H01R 13/18 439/843
8,128,441 B2 * 3/2012 Mukuno ..... H01R 13/055 439/845
8,303,355 B2 * 11/2012 Ono ..... H01R 4/185 439/877
8,485,853 B2 * 7/2013 Seifert ..... H01R 4/188 439/882
8,827,754 B2 * 9/2014 Lee ..... H01R 13/187 439/845
9,118,130 B1 * 8/2015 Volpone ..... H01R 13/113
9,455,504 B2 * 9/2016 Kim ..... H01R 4/188
9,559,467 B1 * 1/2017 Khorrami ..... H01R 13/187
9,966,683 B2 * 5/2018 Sasaki ..... H01R 13/113
10,090,608 B2 * 10/2018 Lewis ..... H01R 24/20
10,103,469 B1 * 10/2018 Humphrey ..... H01R 4/489
10,224,658 B2 * 3/2019 Marsh ..... H01R 13/113
10,230,191 B2 * 3/2019 Lui ..... H01R 43/16
10,256,560 B2 * 4/2019 Fertig ..... H01R 13/113
10,290,965 B1 * 5/2019 Morello ..... H01R 13/11
2001/0039145 A1 * 11/2001 Schaefer ..... H01R 13/187 439/625
2002/0025732 A1 * 2/2002 Hsieh ..... H01R 13/187 439/845
2002/0055297 A1 * 5/2002 Feeny, Jr. ..... H01R 13/15 439/453
2003/0060090 A1 * 3/2003 Allgood ..... H01R 11/289 439/845
2005/0266727 A1 * 12/2005 Yamaguchi ..... H01R 9/0518 439/585
2008/0293287 A1 * 11/2008 Zinn ..... H01R 13/113 439/370
2010/0151748 A1 * 6/2010 Kato ..... H01R 13/113 439/834
2011/0124247 A1 * 5/2011 Okamura ..... H01R 4/188 439/877
2012/0108113 A1 * 5/2012 Yamaguchi ..... H01R 13/187 439/842
2012/0156947 A1 * 6/2012 Tyler ..... H01R 13/113 439/842
2014/0182931 A1 * 7/2014 Furukawa ..... H02G 15/16 174/75 R
2016/0380375 A1 12/2016 Saller et al.

FOREIGN PATENT DOCUMENTS

EP 2752945 A2 7/2014
WO 2016187089 A1 11/2016

* cited by examiner

ANTI-FRETTING/MULTIPLE CONTACT TERMINAL USING KNURL PATTERN

BACKGROUND

Electrical contact between terminals typically relies on the creation of a high-contact force between the components providing the electrical contact. The surface area of the respective electrical contacts may be relatively large, however, due to process variations and other factors only a few electrical contact points are provided between the respective electrical contacts. Additionally, mechanical vibration between the respective components can cause fretting at the point of contact, eventually resulting in a loss of electrical contact as the conductive material is worn away at the one or two electrical contact points. To combat this problem, complex geometries associated with the electrical contacts can be utilized to ensure additional points of contact. However, the added complexity increases the time and cost associated with manufacturing the electrical contact.

It would be beneficial to develop an electrical contact that provides a cost effective system for increasing the number of contact points between respective terminals while maintaining electrical contact in the presence of mechanical vibration/fretting.

SUMMARY

According to some aspects, a female electrical terminal includes a securing end, a mating end located opposite the securing end along a longitudinal coupling axis, and a contact pad. The mating end further includes a housing provided with an opening configured to receive a male contact or terminal. The contact pad is positioned within the housing to contact the male terminal or contact received within the opening, wherein a surface of the contact pad includes a plurality of protrusions extending from the surface.

According to another aspect, a connection assembly may include a female electrical terminal and a male electrical terminal. The female electrical terminal may include a first end and a second end, the first end having an opening and a contact pad located within the first end, wherein a surface of the contact pad is knurled to provide a plurality of protrusions. The male electrical terminal includes a male contact that is received within the opening of the female electrical terminal and placed in contact with the contact pad, wherein electrical contact points are provided between one or more of the plurality of protrusions and the male contact.

According to another aspect, a male electrical contact includes a first surface and a second surface opposite the first surface. The first surface or the second surface may include a contact surface that includes a plurality of protrusions extending from the surface.

DETAILED DESCRIPTION

According to some aspects, a contact pad utilized to make electrical contact with a respective terminal may utilize a knurl pattern to increase a number of contact points between the respective terminals. In some embodiments, the knurl pattern includes a plurality of recessed indents on the contact pad, wherein the plurality of recesses formed in the contact pad cause a plurality of projections or ridges (i.e., knurl pattern) to be formed adjacent the recesses. Each of the plurality of projections provides a possible electrical contact point between the contact pad and the mating terminal. In addition, fretting of one or more of the contact points associated with the contact pad result in a new electrical contact point being created at a different projection along the contact pad. In this way, fretting does not result in a loss of electrical contact between the respective terminals. In some embodiments the plurality of recesses utilized to form the knurl pattern may have various geometries, such as a rhombus shaped recess. Furthermore, a cost-effective and simple stamping process may be utilized to form the plurality of recesses (and therefore the knurl pattern), such that the knurl pattern does not add significantly to the cost of the terminal.

Figure 1:
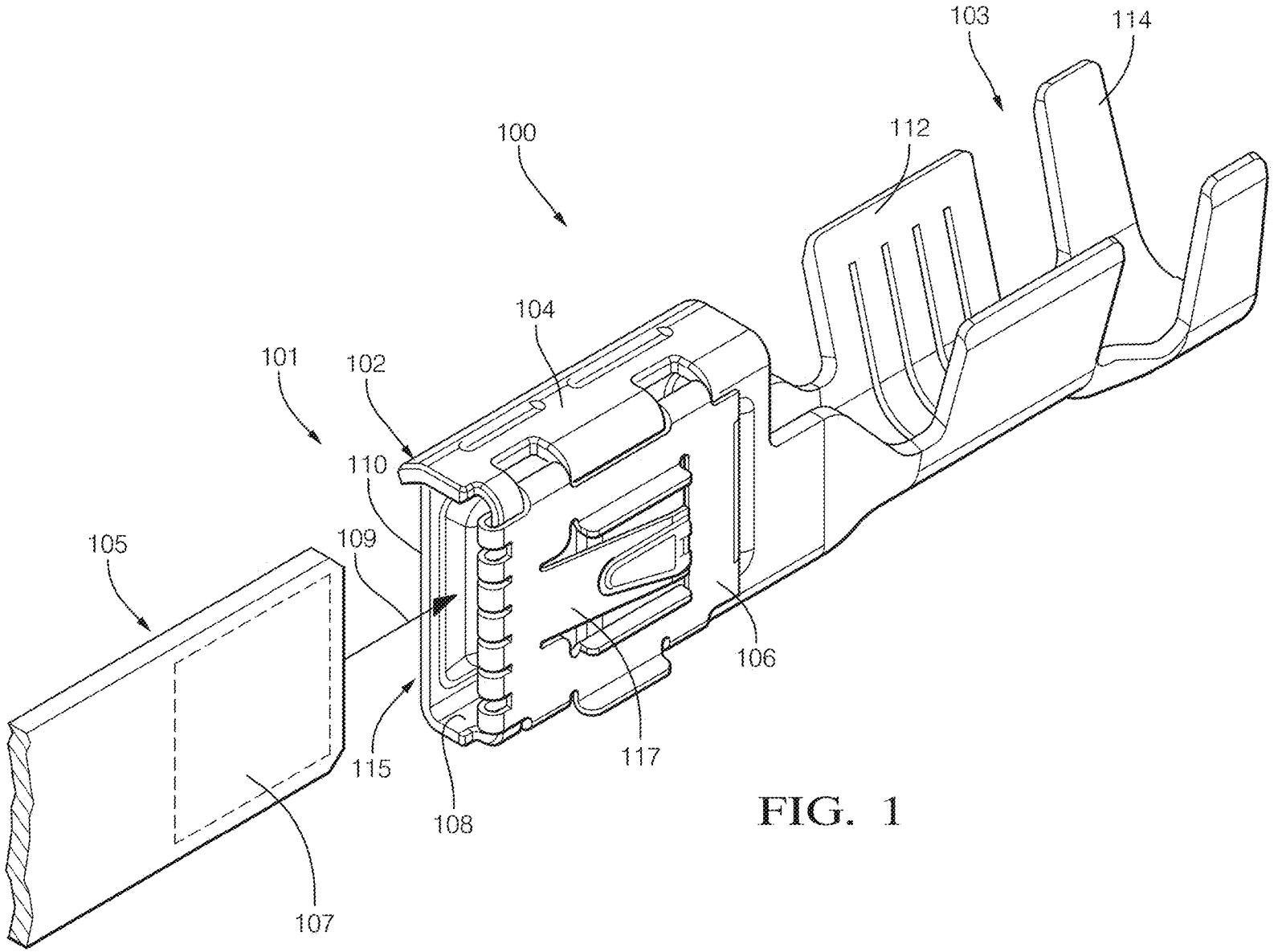
FIG. 1 is an isometric view of a terminal according to some embodiments.
Figure 2:
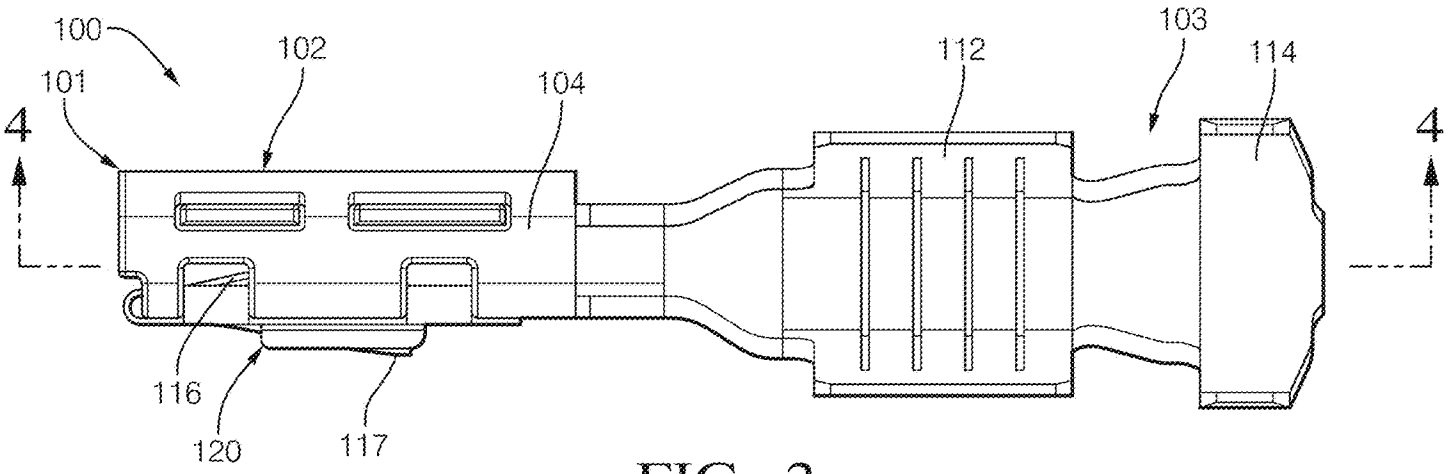
FIG. 2 is a top view of the terminal according to some embodiments.
Figure 3:
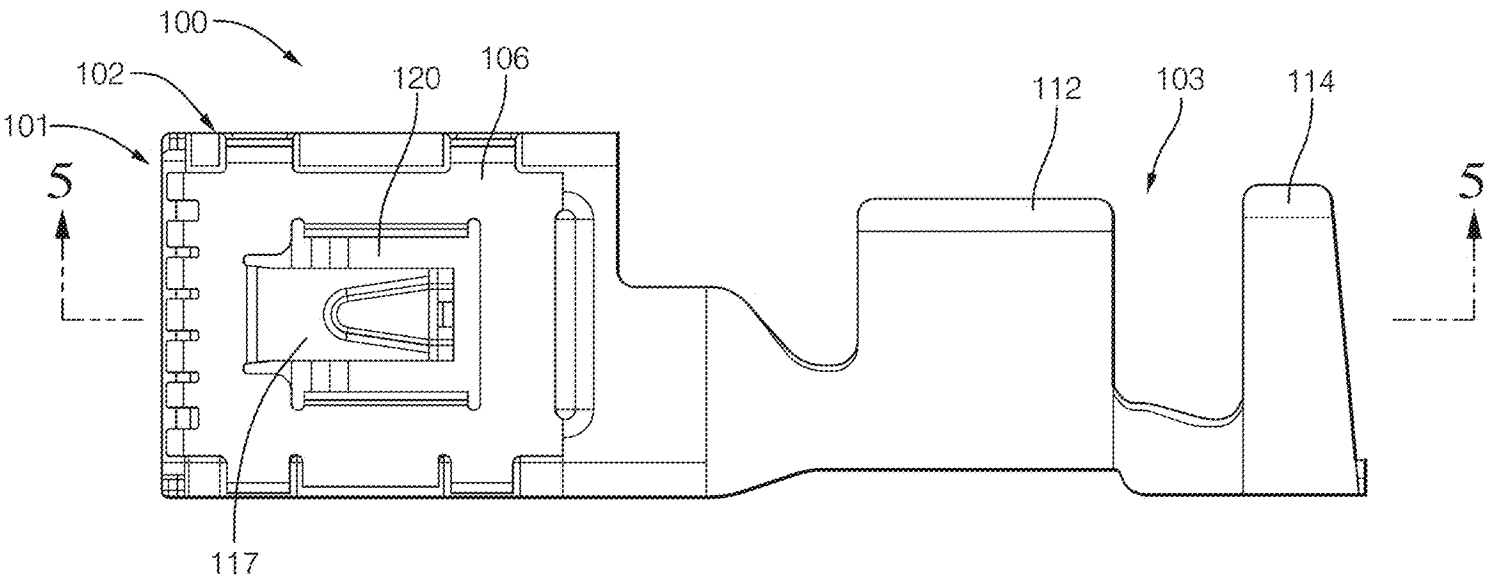
FIG. 3 is a side view of the terminal according to some embodiments.

Referring to FIGS. 1-3 a female electrical terminal 100 is provided that includes a contact pad 130 (shown in FIGS. 4-8) having a knurled surface. The female electrical terminal 100 includes a mating end 101 configured to receive a compatible male electrical terminal (e.g., blade-type contact 105) and a securing end 103 configured to receive and retain a wire/conductor (not shown). A longitudinal coupling axis is defined between the mating end 101 and the securing end 103, in the direction of coupling indicated by arrow 109. The mating end 101 includes a housing 102 comprised of a plurality of walls including first and second side walls 104, 108, bottom wall 106, and top wall 110. The housing extends longitudinally toward the securing end 103, and the plurality of walls define an opening 115 configured to receive and retain blade-type contact 105. In some embodiments, the blade-type contact 105 received within the opening 115 is retained, in part, by contact force spring 116. In some embodiments, the contact force spring 116 provides a contact force that ensures engagement between a portion of the blade-type contact 105 and the contact pad 130 located on an inner surface of the housing and having a knurled surface (described in more detail with respect to FIGS. 4-7, below). A spring lock 117 is positioned on bottom wall 106 utilized to lock the terminal 100 into the connector housing. The securing end 103 includes a conductor wing 112 and an insulation wing 114. A wire (not shown) received at the securing end 103 is secured to the female electrical terminal 100 by crimping the conductor wing 112 (at a conductive or exposed length of the wire) and further secured by crimping the insulation wing 114 around a portion of the wire. The terms "top" and "bottom" are utilized to differentiate between the respective sidewalls, although it should be understood that these terms do not require that the top wall 110 being located at a location above the bottom wall 106. Depending on the installation of the female electrical terminal 100, the respective sidewalls may be positioned in any orientation relative to one another.

Figure 4:
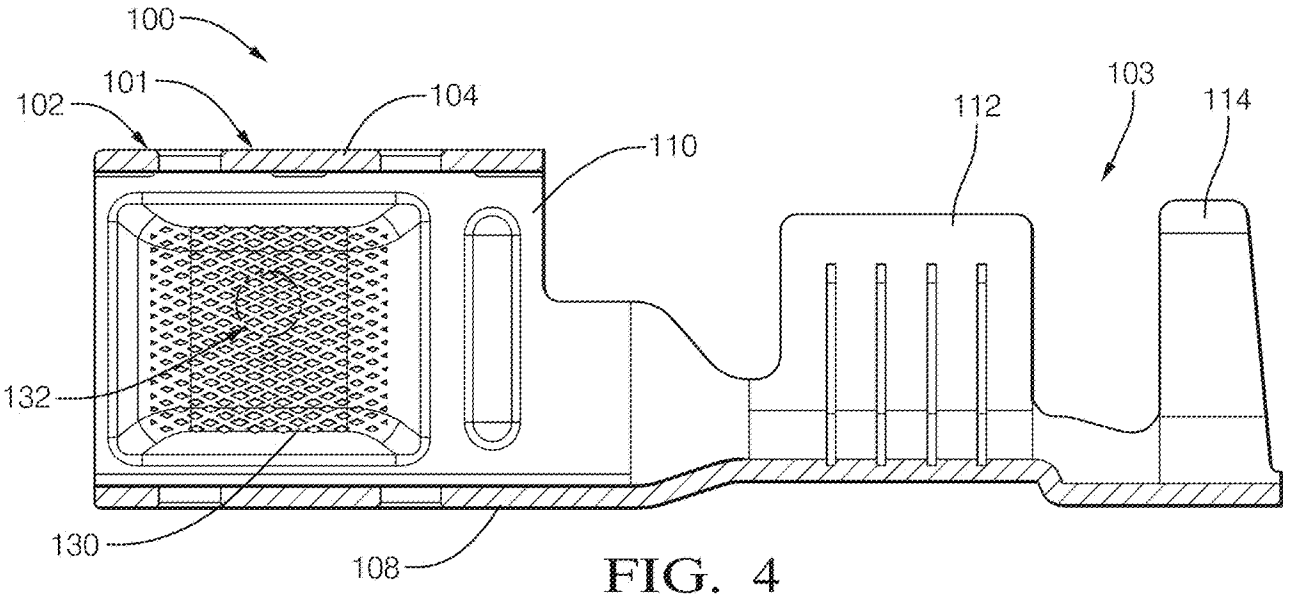
FIG. 4 is a cross-sectional view of the terminal taken along line 2-2 shown in FIG. 2 according to some embodiments.
Figure 5:
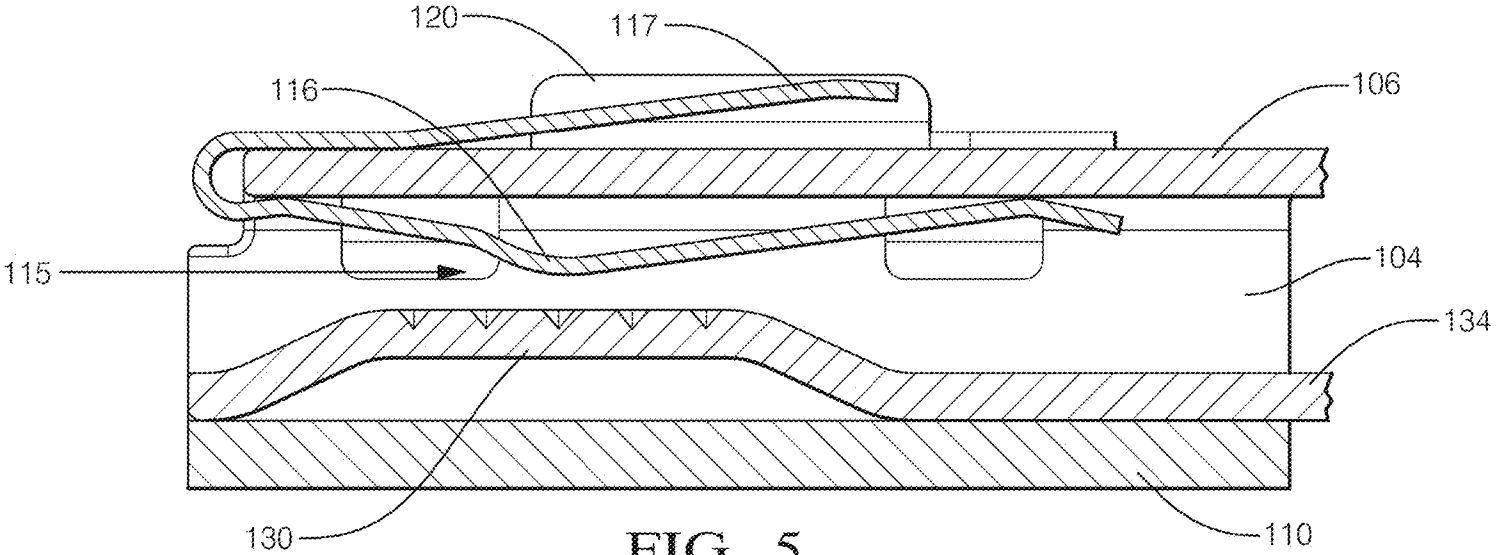
FIG. 5 is a cross-sectional view of the terminal taken along line 3-3 shown in FIG. 3 according to some embodiments.

Referring now to FIGS. 4 and 5, cross-sectional views of the female electrical terminal 100 are shown according to some embodiments. FIG. 4 is a cross-sectional view of the female electrical terminal 100 taken along line 2-2 shown in FIG. 2. FIG. 5 is a cross-sectional view of the female electrical terminal 100 taken along line 3-3 shown in FIG. 3.

In the cross-sectional view shown in FIG. 4, the knurled contact pad 130 is located on an interior surface of top wall 110. In some embodiments, the knurled contact pad 130 is located on a raised platform. For example, in the cross-sectional view shown in FIG. 5, contact pad 130 is located on a raised platform that extends into the interior of the housing 102 toward contact force spring 116. A male electrical terminal—for example a blade-type connector such as 105 shown in FIG. 1—inserted into opening 115 is forced into contact with contact pad 130 by the contact force exerted by contact force spring 116. The knurled surface of contact pad 130 ensures a plurality of contact points between the contact pad 130 and the blade-type connector 105. In some embodiments, the knurled surface of the contact pad 130 includes a plurality of recesses or indents formed in the contact pad. As discussed in more detail below with respect to FIGS. 6 and 7, in some embodiments the plurality of recesses are fabricated using a press operation. Formation of each of the recesses using a press operation results in generation of a corresponding protrusion (shown in FIG. 7) directed towards the contact force spring 116 that opposes the contact pad 130. The blade-type connector 105 comes into contact with one or more of these protrusions extending from the knurled surface of contact pad 130. Subsequent fretting caused by mechanical vibration between the contact pad 130 and the blade-type contact 105 may result in the points of contact between the blade-type contact 105 and the contact pad 130 changing from one or more first sets of protrusions to one or more second sets of protrusions.

In some embodiments, the contact pad 130 extends along a significant portion of the top wall 110. For example, in some embodiments the contact pad 130 extends along at least 50% of the length of top wall 110. In some embodiments the contact pad 130 extends along at least 75% of the length of the top wall 110.

In some embodiments, contact force spring 116 is secured to an outer surface of bottom wall 106 via spring fixture 120 (shown in FIG. 5) located on an exterior surface of bottom wall 106. A first portion of the contact force spring 116 extends toward the opening 115 and then a second part extends into the opening and toward contact pad 130. When the blade-type contact 105 is inserted into the opening, the contact force spring 116 is flexed, resulting in a contact force being generated by the contact force spring 116 that urges the blade type contact 105 into contact with the contact pad 130.

Figure 6:
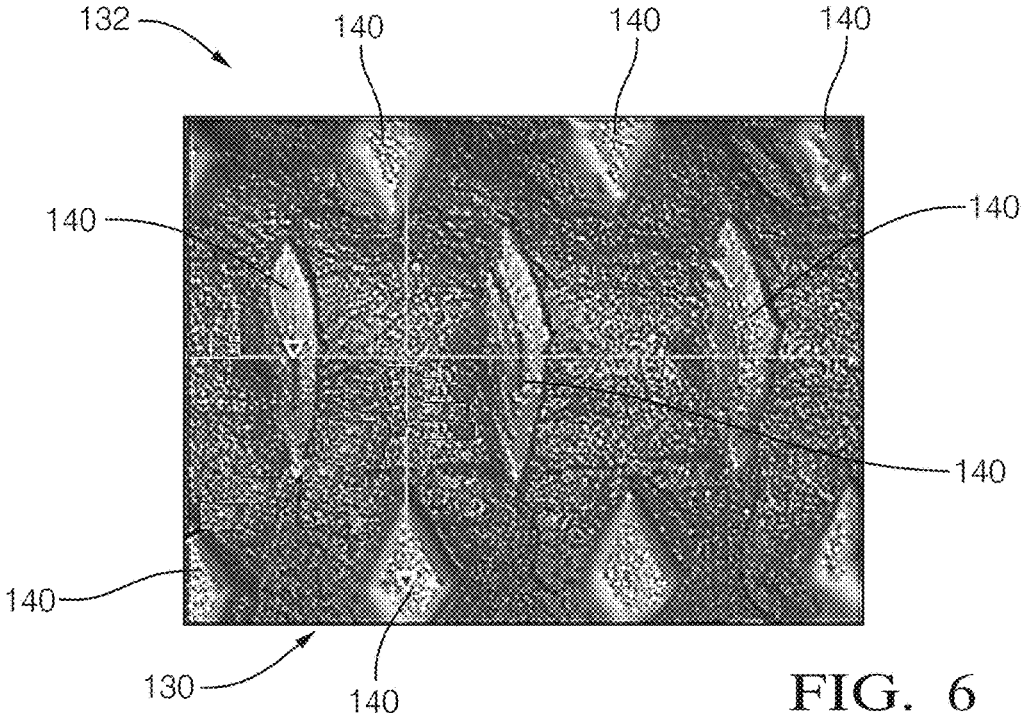
FIG. 6 is a magnified view of the knurl pattern formed on the contact pad according to some embodiments.
Figure 7:
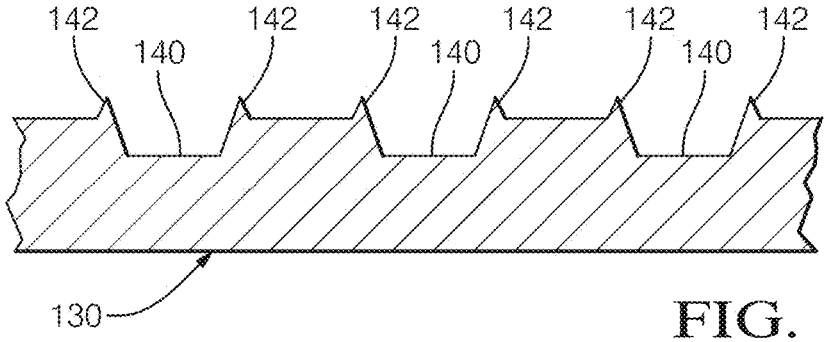
FIG. 7 is a cross-sectional view of the contact pad taken along line 6-6 that illustrates the projections created by the recesses made in the contact pad according to some embodiments.

Referring to FIGS. 6 and 7, the knurled surface of the contact pad is discussed in more detail according to some embodiments. In particular, FIG. 6 is a magnified view of a portion of the knurled surface (portion 132, shown in FIG. 4) of contact pad 130. FIG. 7 is a cross-sectional view of knurled surface taken along line 6-6 as shown in FIG. 6. In some embodiments, the knurled surface is comprised of a plurality of recesses 140 formed on a surface of the contact pad 130. In the embodiment shown in FIG. 6, the plurality of recesses 140 have a rhombus geometry. In other embodiments, various other geometries may be utilized to form the recesses 140. In some embodiments, the knurled surface may include recesses having more than one size, depth, and/or geometry. Modifying one or more of the size, depth, and/or geometry of the recesses 140 may result in a modification of the plurality of protrusions 142 (shown in FIG. 7) formed adjacent to the recesses 140 as a result of recess formation. In some embodiments, the recesses 140 are fabricated as part of the stamping process utilized for fabricate the contact pad 130. In some embodiments, the knurl pattern is fabricated on the portion of contact pad 130 expected to come into contact with the male terminal. For example, in some embodiments the male terminal is a blade-type connector, wherein the width of the knurl pattern would be equal to or greater than a width of the blade-type contact 105.

FIG. 7 is a cross-sectional view that illustrates a plurality of recesses 140 and corresponding plurality of protrusions 142 located adjacent each of the plurality of recesses 140. In some embodiments, prior to the stamping process the contact pad has an essentially flat surface defined by plane P. In some embodiments, the plurality of recesses 140 are fabricated using a stamping process, which as a result of the recess fabrication generates a plurality of protrusions 142 adjacent each of the plurality of recesses 140. The height of the plurality of protrusions 142 depend on the size, depth, and geometry of the plurality of recesses. Although the embodiment shown in FIG. 7 includes approximately uniform depth of the plurality of recesses 140 and approximately uniform height of the plurality of protrusions 142, in some embodiments the depth of the plurality of recesses 140 and the height of the plurality of protrusions 142 will exhibit variation. In some embodiments, variation in the height of the plurality of protrusions 142 is desirable to provide a plurality of initial contact points associated with a first plurality of protrusions located at a first height (i.e., greatest height) and a plurality of secondary contact points associated with a second plurality of protrusions. Fretting of one or more of the first plurality of protrusions first brought into contact with the male terminal results in one or more of the second plurality of protrusions being brought into contact with the male terminal. In this way, fretting of contact points does not result in a loss of electrical connection between the male terminal and the contact pad 130.

Figure 8:
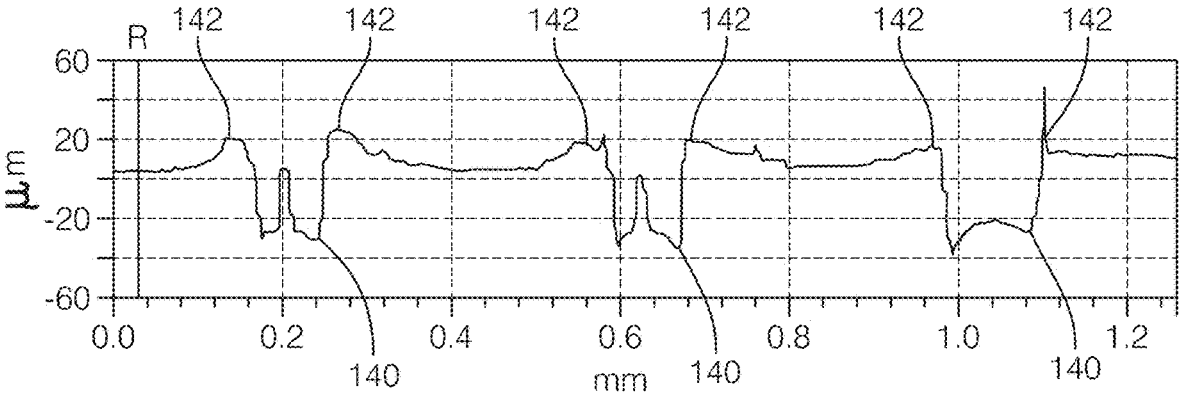
FIG. 8 is a chart illustrating height of the contact pad along a planar axis according to some embodiments.

FIG. 8 is a graph illustrating the height of the recesses 140 and protrusions 142 associated with the contact pad according to some embodiments. The planar surface of the contact pad 130 is assigned a reference height of zero. In some embodiments, the recesses 140 are defined by a depth of approximately negative twenty to negative forty micrometers (μm) and the protrusions 142 are defined by a height of approximately fifteen to twenty-five μm. In some embodiments, the recesses 140 having a depth that is greater than the height of the protrusions 142. In some embodiments, this is a result of the press operation, in which a press including a plurality of protrusions is utilized to form the recesses 140. The protrusions 142 are formed as a result of the movement of material in formation of the recesses 140. One of the benefits of contact pad 130 is the non-uniformity associated with the heights of the plurality of protrusions 142. For example, in the embodiment shown in FIG. 8, the protrusions 142 having the greatest height will create the first contact points between the contact pad 130 and the male terminal, while the protrusions having lesser heights will not (at least initially) be brought into contact with the male terminal. As the protrusions 142 having the greatest height fret and wear to the point of loss of contact with the male terminal, protrusions having lesser heights initially will be brought into contact with the male terminal. In this way, electrical contact is maintained between the contact pad 130 and the male terminal despite the presence of fretting and wear.

Figure 9:
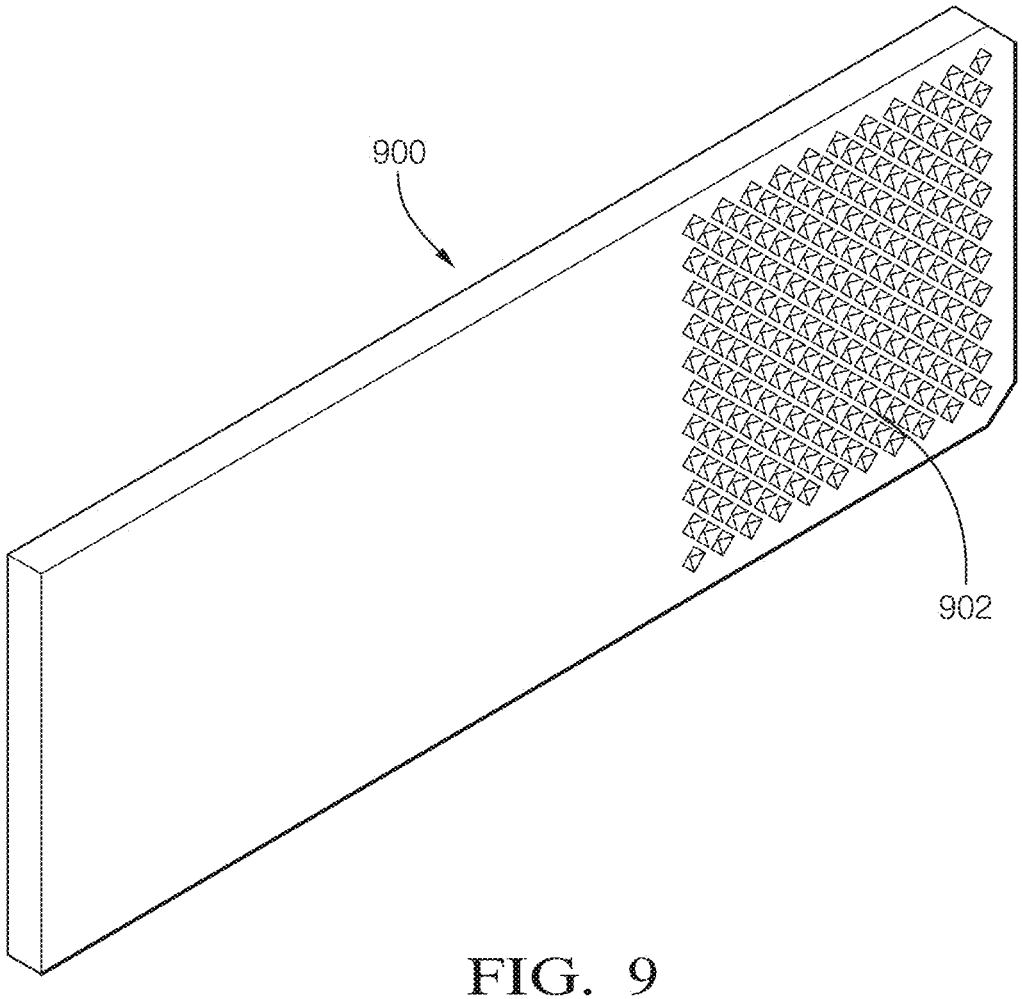
FIG. 9 is an isometric view of a male electrical terminal having a male contact that includes a knurled surface according to some embodiments.

FIG. 9 is an isometric view of a blade type contact 900 that includes a knurled contact area 902 according to some embodiments. In contrast to embodiments shown—for example—in FIGS. 4 and 5, in the embodiment shown in FIG. 9 the knurled surface of the male blade type connector 900 inserted into the opening associated with the female electrical terminal (not shown). In some embodiments, knurled contact area 902 includes a plurality of protrusions formed along a first surface to provide the desired knurling. In some embodiments, both a first side and a second side located opposite the first side of the blade type contact 900 may be knurled to ensure that regardless of the orientation of the blade type contact 900 the knurling will come into contact with the contact pad of the female electrical terminal. As discussed above, in some embodiments the knurled surface is created via formation of a plurality of recesses formed on the surface of the blade type connector 900, which results in a plurality of protrusions being formed on the surface that provides the desired knurling of contact area 902. In some embodiments, if the male blade type connector 900 includes a knurled contact area 902 then the contact pad located on the female terminal (not shown) may not include a knurled surface. That is, in some embodiments only one of the contact surfaces is knurled. In other embodiments, both the male blade type connector and the contact pad included as part of the female terminal may include knurled surfaces that interact with one another.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. Discussion of Possible Embodiments The following are non-exclusive descriptions of possible embodiments of the present invention.

According to some aspects, a female electrical terminal includes a securing end, a mating end located opposite the securing end along a longitudinal coupling axis, and a contact pad. The mating end further includes a housing provided with an opening configured to receive a male contact pad located within the housing and oriented to be brought into contact with the male contact received within the opening, wherein a surface of the contact pad includes a plurality of protrusions extending from the surface.

The female electrical terminal of the preceding paragraph can optionally include, additionally and/or alternatively any, one or more of the following features, configurations, and/or additional components.

For example, in some embodiments the plurality of protrusions may be non-uniform in height.

In some embodiments, one or more contact points may be formed between one or more of the plurality of protrusions and the male contact, and wherein the one or more contact points may migrate over time in response to fretting of original contact points.

In some embodiments, the contact pad may include a plurality of recesses.

In some embodiments, the plurality of protrusions may be formed in response to formation of the plurality of recesses.

In some embodiments, the plurality of recesses may be rhombus shaped.

In some embodiments, the housing may include at least a bottom wall, a top wall, and two side walls extending between the bottom wall and the top wall defining an opening for receiving the male contact, wherein the contact pad is located on an inner surface of the bottom wall or top wall.

In some embodiments, the female electrical terminal may further include a spring affixed to the top wall that extends into the opening within the housing, wherein the spring is placed in contact with the male contact to provide contact force between the male contact and the contact pad.

In some embodiments, the securing end may include a conductive wing and an insulator wing.

According to another aspect, a connection assembly may include a female electrical terminal and a male electrical terminal. The female electrical terminal may include a first end and a second end, the first end having an opening and a contact pad located within the first end, wherein a surface of the contact pad is knurled to provide a plurality of protrusions. The male electrical terminal includes a male contact that is received within the opening of the female electrical terminal and placed in contact with the contact pad, wherein electrical contact points are provided between one or more of the plurality of protrusions and the male contact.

The connection assembly of the preceding paragraph can optionally include, additionally and/or alternatively any, one or more of the following features, configurations, and/or additional components.

For example, in some embodiments the first end may include a housing defining the opening for receiving the male contact.

In some embodiments, the housing may include at least a top wall, a bottom wall, and two side walls extending between the top wall and the bottom wall, wherein the top wall, the bottom wall and the two side walls form the opening for receiving the male contact and wherein the contact pad is located on an inner surface of the bottom wall.

In some embodiments, the female electrical terminal may further include a spring affixed to the top wall that extends into the opening, wherein the spring provides contact force between the male contact and the contact pad.

In some embodiments, the plurality of protrusions may be non-uniform in height.

In some embodiments, the contact pad may include a plurality of recesses.

In some embodiments, the plurality of recesses may be rhombus-shaped.

According to another aspect, a male electrical contact includes a first surface and a second surface opposite the first surface. The first surface or the second surface may include a contact surface that includes a plurality of protrusions extending from the surface.

The male electrical contact of the preceding paragraph can optionally include, additionally and/or alternatively any, one or more of the following features, configurations, and/or additional components.

For example, in some embodiments, the plurality of protrusions may be non-uniform in height.

In another embodiment, one or more contact points may be formed between one or more of the plurality of protrusions and a contact pad associated with a female terminal.

In another embodiment, the contact surface may include a plurality of recesses.

In another embodiment, the plurality of protrusions may be formed in response to formation of the plurality of recesses.

The invention claimed is:

1. A female electrical terminal comprising:

a securing end;

a mating end coupled along a longitudinal axis to the securing end, the mating end including a housing provided with an opening configured to receive a male contact; and a contact pad located within the housing and having a surface positioned to contact the male contact received within the opening, wherein the surface of the contact pad includes a plurality of protrusions extending from the surface that are non-uniform in height, wherein a contact point is formed between a first protrusion of the plurality of protrusions and the male contact and wherein the contact point migrates over time to a second protrusion of the plurality of protrusions in response to fretting of the first protrusion.

2. The female electrical terminal of claim 1, wherein the surface of the contact pad includes a plurality of recesses.

3. The female electrical terminal of claim 2, wherein the plurality of protrusions are formed in response to formation of the plurality of recesses.

4. The female electrical terminal of claim 2, wherein the plurality of recesses are rhombus shaped.

5. The female electrical terminal of claim 1, wherein the housing includes at least a bottom wall, a top wall, and two side walls extending between the bottom wall and the top wall defining an opening for receiving the male contact, wherein the contact pad is located on an inner surface of the bottom wall or top wall.

6. The female electrical terminal of claim 5, further including:

a spring affixed to the housing that extends into the opening within the housing, wherein the spring is placed in contact with the male contact to provide contact force between the male contact and the contact pad.

7. The female electrical terminal of claim 1, wherein the securing end includes a conductor wing and an insulator wing.

8. A connection assembly comprising:

a female electrical terminal having a first end and a second end, the first end having an opening and a contact pad located within the first end, wherein a surface of the contact pad is knurled to provide a plurality of protrusions extending from the surface that are non- uniform in height; and a male electrical terminal having a male contact that is received within the opening of the female electrical terminal and placed in contact with the contact pad, wherein a contact point is formed between a first protrusion of the plurality of protrusions located at a first height and the male contact, wherein the contact point migrates over time in response to fretting of the first protrusion and is formed between a second protrusion of the plurality of protrusions located at a second height and the male contact, and wherein the second height is less than the first height.

9. The connection assembly of claim 8, wherein the first end includes a housing defining the opening for receiving the male contact.

10. The connection assembly of claim 9, wherein the housing includes at least a top wall, a bottom wall, and two side walls extending between the top wall and the bottom wall, wherein the top wall, the bottom wall and the two side walls form the opening for receiving the male contact and wherein the contact pad is located on an inner surface of the bottom wall.

11. The connection assembly of claim 10, wherein the female electrical terminal further includes a spring affixed to the top wall that extends into the opening, wherein the spring provides contact force between the male contact and the contact pad.

12. The connection assembly of claim 9, wherein the contact pad includes a plurality of recesses.

13. The connection assembly of claim 12, wherein the plurality of recesses are rhombus-shaped.

14. A male electrical terminal configured for electrically contacting a contact pad of a female terminal, comprising:

a first surface; and a second surface located opposite the first surface, wherein one of the first surface or the second surface includes a contact surface that includes a plurality of protrusions extending from the contact surface, wherein a first contact point is formed at a first location between a first one of the plurality of protrusions extending from the contact surface to a first height and the contact pad associated with the female terminal, wherein a second contact point is formed at a second location between a second one of the plurality of protrusions extending from the contact surface to a second height and the contact pad in response to fretting of the first one of the plurality of protrusions over time, and wherein the second height is less than the first height.

15. The male electrical terminal of claim 14, wherein the contact surface includes a plurality of recesses and wherein the plurality of protrusions are formed in response to formation of the plurality of recesses.

16. The male electrical terminal of claim 15, wherein the plurality of recesses are rhombus-shaped.

* * * * *